US006575445B1

(12) United States Patent
Garlichs et al.

(10) Patent No.: US 6,575,445 B1
(45) Date of Patent: Jun. 10, 2003

(54) JACKET-LAYING-ON DEVICE FOR BOOKBINDING MACHINES

(75) Inventors: Jurgen Garlichs, Rahden (DE); Klaus Hampel, Bielefeld (DE)

(73) Assignee: Kolbus GmbH & Co. KG, Rahden (DE)

( * ) Notice: Subject to any disclaimer, the term of this patent is extended or adjusted under 35 U.S.C. 154(b) by 91 days.

(21) Appl. No.: 09/675,806

(22) Filed: Sep. 29, 2000

(30) Foreign Application Priority Data

Oct. 1, 1999 (DE) ..... 199 47 375

(51) Int. Cl.[7] ..... B42C 11/02

(52) U.S. Cl. ..... 270/52.18; 270/58.07; 412/4; 412/19; 412/21; 412/24

(58) Field of Search ..... 270/58.08, 58.07, 270/52.18; 412/4, 5, 19, 21, 27

(56) References Cited

U.S. PATENT DOCUMENTS 4,080,678 A * 3/1978 Muller ..... 270/58.08
4,491,448 A * 1/1985 Anders et al. ..... 198/418.2
4,710,256 A * 12/1987 Ladewig et al. ..... 156/216
5,429,468 A * 7/1995 Kojima ..... 412/19
6,354,582 B1 3/2002 Hafer et al.

FOREIGN PATENT DOCUMENTS

| | | | |
|---|---|---|---|
| DE | 26 40 496 A1 | | 3/1977 |
| DE | 2815143 A | * | 10/1978 |
| DE | 31 26 403 A1 | | 6/1982 |
| DE | 19756353 A1 | * | 6/1999 |
| DE | 19903163 A1 | * | 8/2000 |
| GB | 2082506 A | * | 3/1982 |

* cited by examiner

*Primary Examiner*—Christopher P. Ellis
*Assistant Examiner*—Patrick Mackey
(74) *Attorney, Agent, or Firm*—Alix, Yale & Ristas, LLP

(57) ABSTRACT

The bookbinding machine with a transport system for continuously conveying stacks of sheets at cyclical intervals having a jacket-laying-on device with a chain conveyer, and transporters which engage behind the jackets and feed them to the stacks of sheets in an aligned and synchronous manner. The movement of the transporters is controlled in such a way that they maintain their perpendicular position in the rerouting system after the feeding-in of the jackets.

10 Claims, 2 Drawing Sheets

A
B
1
2
3
3a
4
5
5a
5b
6
7
8
9
10
11
12
13
15
2a

JACKET-LAYING-ON DEVICE FOR BOOKBINDING MACHINES

BACKGROUND OF THE INVENTION

The invention relates to a bookbinding machine with a transport system for continuously conveying stacks of sheets at cyclical intervals, consisting of a conveyer chain which runs around rerouting sprocket wheels and has individual links which engage movably in one another and have a multiplicity of clamps for clamping-in the stacks of sheets, which clamps are disposed at equal mutual intervals from one another and movably on the conveyer chain, driving-wise, and are guided in tracks on a machine frame; with a number of processing stations along rectilinear conveyer sections; with a jacket-laying-on device with a chain conveyer which is disposed underneath the plane of movement of the stacks of sheets, runs round rerouting sprocket wheels and has transporters which engage behind the jackets and feed them to the stacks of sheets in an aligned manner; and with an elevating platform which takes over the jackets and presses them onto the back of the stacks of sheets, moves synchronously with the clamps during the pressing-on of the jackets and optionally has pressing-on means for pressing the jackets onto the lateral regions of the stacks of sheets.

In the jacket-laying-on device, which is known from DE-OS 26 40 497, of a bookbinding machine, entrainment means which engage behind jackets are driven by a chain system which circulates at periodically changing speeds. In this process, the entrainment means feeding-in the jacket first move at a speed which is higher than the speed of circulation of the clamps, in order to catch up with a clamp which is running in front and to lay themselves on the latter for alignment purposes, and are then braked, against the action of a spring, while being laid on the clamp.

DE-OS 28 15 143 indicates another jacket-laying-on device in a bookbinding machine, in which the running speed of the chain for conveying the jackets is periodically increased and reduced by a differential gear unit and by a control cam provided with a curved groove, so that the location of the jacket in relation to the book block changes during the conveying of the said jacket, namely in such a way that the jacket advanced by the entrainment means overtakes the book block and the rear edge of the jacket and rear edge of the book block are thereby aligned in relation to one another.

The jacket-laying-on devices known from the prior art which have aligning systems are extremely costly from the design and production engineering points of view, as well as entailing considerable expenditure of time for setting up the aligning system.

SUMMARY OF THE INVENTION

The object of the invention consists in providing a jacket-laying-on device for bookbinding machines of the generic type, which requires a lower outlay on construction and guarantees high accuracy of positioning of the jacket in relation to the book block, with a high cyclical sequence. The jacket-laying-on device is also to be capable of being set up in an extremely short time and, in addition, of being adjusted, while the machine is running, with respect to different projections of the jacket in relation to the stacks of sheets.

The object is achieved by means of a chain conveyer or like conveyer means which is disposed in front of the elevating platform for the purpose of directly feeding-in the jackets in a cyclically synchronous manner in relation to the stacks of sheets and has projecting transporters which reach beyond rerouting sprocket wheels on the discharge side of the chain conveyer as far as a defined distance from the elevating platform, and the movement of which is controlled in such a way that they maintain their perpendicular position in the rerouting system after the feeding-in of the jackets. In a preferred development of the invention, the chain conveyer can be driven, with the transporters, by the driven sprocket wheel of the transport system and the jackets can be fed, with a defined projection in relation to the stack of sheets, to the elevating platform via the transporters in a continuous movement.

Other advantageous features of the invention form the subject of the remaining dependent claims.

With the aid of the jacket-laying-on device according to the invention, the jackets are fed directly to the elevating platform for pressing onto the back of the stack of sheets. The transporters take over the jackets detached by the laying-on system and transport them to the elevating element in a uniform pattern of movement. Accelerating and braking systems are not needed. As a result of the rerouting operation, the speed of transport of the transporters is automatically retarded, compared with the movement of the clamps, immediately after transfer to the elevating platform. Because of the transporters which project a long way, the chain conveyer can remain outside the range of movement of the elevating platform as well as of the pressing-on means for the lateral regions of the stacks of sheets. The direct driving of the chain conveyer by the driven sprocket wheel of the transport system of the bookbinding machine guarantees high accuracy of synchronism between the clamps and transporters.

BRIEF DESCRIPTION OF THE DRAWING

The invention will be described in greater detail below with the aid of a preferred exemplified embodiment which is represented diagrammatically in the drawings, in which.

DESCRIPTION OF THE PREFERRED EMBODIMENT

Figures 1, 2, 3:
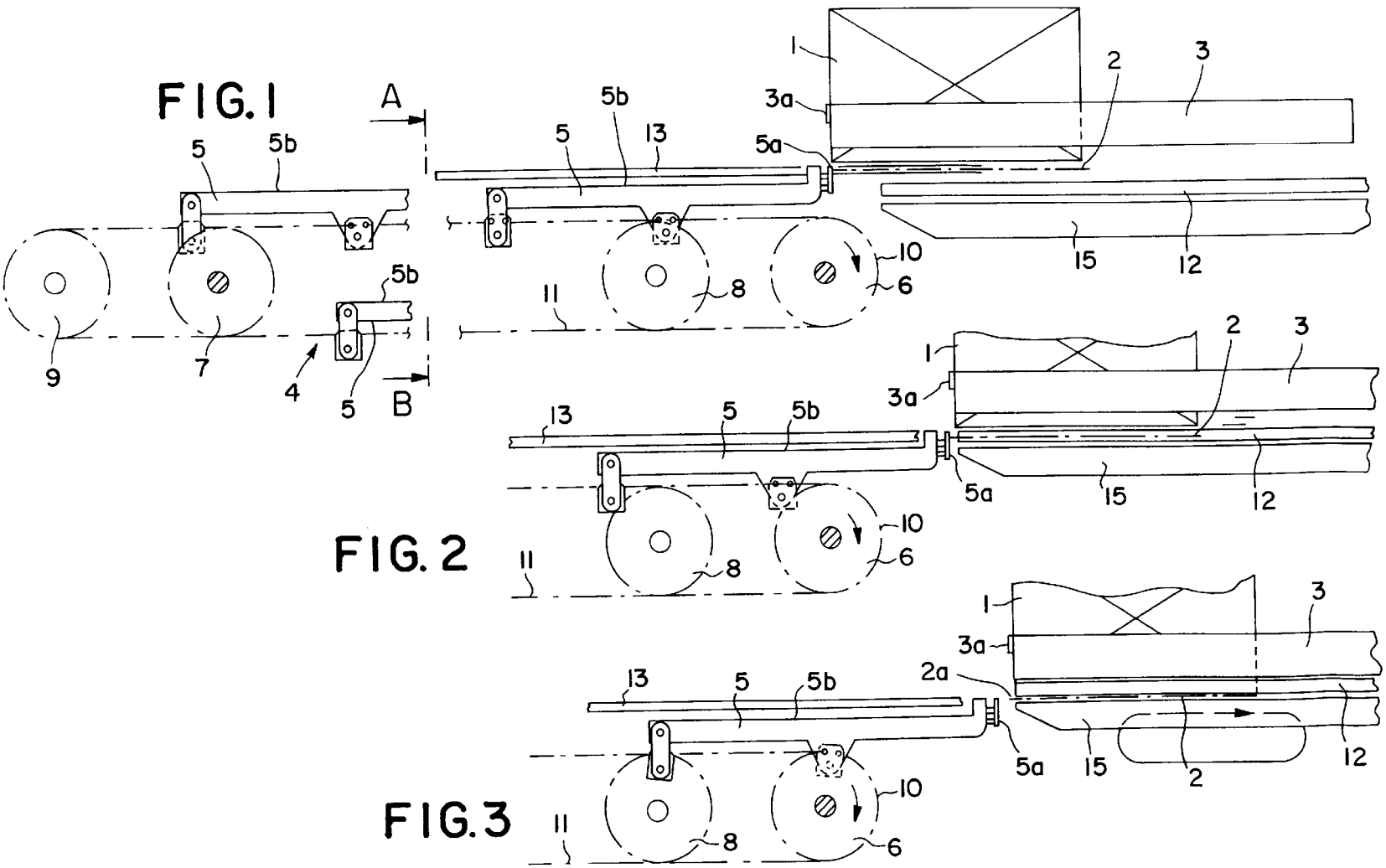
FIG. 1 shows a jacket-laying-on device in a bookbinding machine in side view, partially cut away.
FIGS. 2 & 3 show the jacket-laying-on device in different phases of the operation.
Figure 4:
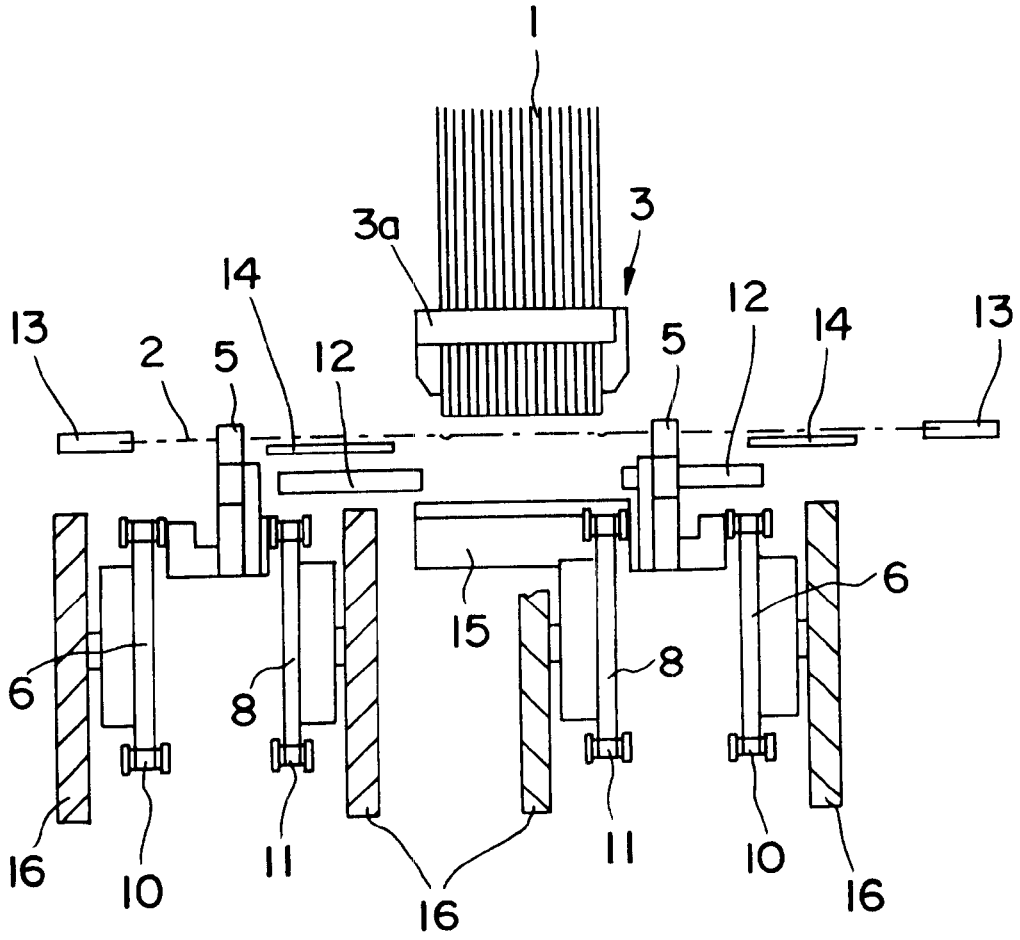
FIG. 4 shows the jacket-laying-on device in front view, along the line of intersection A–B in FIG. 1.

As is known, a bookbinding machine has a multiplicity of clamps belonging to a transport system which are located at equal mutual cyclical intervals from one another and can be moved continuously in a closed circulating track for the purpose of clamping-in and continuously conveying book blocks 1 which are aligned with their rear edge on a stop 3*a*. The transport system consists of a conveyer chain which runs round rerouting sprocket wheels, and the clamps 3, which are guided in tracks on a machine frame, are disposed so as to be movable on the conveyer chain, driving-wise, and convey the book blocks 1 in the clamps 3 along rectilinear sections through processing stations.

The bookbinding machine also has an entry and exit on the driving side and a jacket-laying-on device 4 on the opposite end of the machine from the entry and exit.

The jacket-laying on device 4 is located underneath the path of movement of the clamps 3 and has a multiplicity of right-hand and left-hand transporters 5, having frontal shoulders 5*a*. The transporters are disposed at the same cyclical interval as the clamps 3 and interact in pairs, on chain systems on either side of a longitudinal center line which are driven in a circulating manner. The transporters have an upper surface 5*b*, which is perpendicular to a vertical plane. The chain systems consist, in each case, of pairs of chains 10 and 11, on which are articulated the transporters 5 which engage behind (i.e. at a trailing edge 2*a* of) the detached jackets 2 after departure from a scoring station and feed them, supported on a support 14 and guided in lateral rails 13, to the book blocks 1 in a cyclically synchronous manner, aligned onto the rear edge, with a defined projection in relation to the elevating platform 15. The transporters maintain their perpendicular position in the rerouting system after the feeding-in of the jackets. The chains 10 and 11 run round sprocket wheels 6, 7 and 8, 9 in lateral parts 16 of the jacket-laying-on device 4, and are directly driven by the driven sprocket wheel of the transport system for the clamps 3, a fact which makes possible high accuracy of synchronism in relation to the clamps 3 of the transport system.

The elevating platform 15, which is located immediately behind the jacket-laying-on device 4, takes over the jackets 2, which are aligned in relation to the book blocks 1, from the transporters 5 in order to press them onto the back of the book blocks 1. Displaceably mounted on the elevating platform 15 are lateral pressing-on rails 12 which additionally press the jackets 2 onto those lateral regions of the book blocks 1 which are near the back, while they are being pressed onto the back. The elevating platform 15 performs, in known manner, a vertical movement and also a horizontal movement over a defined path section, synchronously with the continuously running transport system for the clamps 3, while in the process, the lateral pressing-on rails 12 simultaneously move inwards in the horizontal direction.

For the purpose of directly feeding-in the jackets 2 in a cyclically synchronous manner in relation to the book blocks 1 conveyed in the clamps 3, the transporters 5 are, according to the invention, constructed on the jacket-laying-on device 4 disposed in front of the elevating platform 15, in such a way as to project beyond the rerouting sprocket wheels 6 on the discharge side of the chain systems, and reach as far as a defined distance from the elevating platform 15, which is thus able to move freely outside the chain systems of the jacket-laying-on device. Via an adjusting system for the drive of the transporters 5, which adjusting system is not represented in detail, it is possible to set the projection of the jackets 2 on the elevating table 15, and thus the position of the jackets 2 with respect to the rear edge of the book blocks 1, while the bookbinding machine is running.

For the purpose of performing a rectilinear parallel movement in the rerouting system, the chains 10 and 11 are offset relative to one another in pairs in the conveying plane, and the transporters 5 are designed as couplers which connect the chains 10 and 11, which are offset relative to one another in pairs, to one another in an articulated manner. Tilting of the transporters at the rerouting points is precluded. The transporters maintain their perpendicular position and the speed of transport is automatically retarded, compared with the clamps 3.

After being taken over by the transporters after the scoring station, the jackets 2 are not subjected to any acceleration up to the feeding-in of the book blocks, a fact which guarantees high accuracy of positioning with a high cyclical sequence. The jacket-laying-on device according to the invention differs in an advantageous manner from the prior art in so far as it needs no accelerating and braking systems and is consequently simple in design and favourable in terms of production engineering and also costs.

What is claimed is:

1. A bookbinding machine comprising:

a transport system for continuously conveying stacks of sheets at cyclical intervals, having a clamp conveyer with clamps for clamping-in the stacks of sheets, said clamps being movable in a plane in a driving-wise direction;

a jacket-laying-on device having a jacket chain conveyer with a discharge end and jacket conveyor rerouting sprocket wheels at said discharge end, said jacket conveyor being disposed underneath the plane of movement of the stacks of sheets and having chains which run around the jacket conveyor rerouting sprocket wheels;

a pair of transporters having an upper surface with said upper surface being in a perpendicular position relative to a vertical plane, the transporters being attached by coupling means to the jacket conveyor chains, the transporters having a jacket engagement surface to engage behind the jackets for transporting the jacket to the stacks of sheets in an aligned manner, said transporters projecting beyond the rerouting sprocket at discharge end of jacket conveyor in a controlled movement so as to maintain the perpendicular position after transporting the jackets; and an elevating platform which directly receives the jackets from the transporters and presses the jackets onto a back surface of the stacks of sheets, said platform moves with the clamps in a cyclically synchronous manner in relation to stacks of sheets during the pressing-on of the jackets.

2. A bookbinding machine according to claim 1, wherein the jacket chain conveyer can be driven, with the transporters, by the transport system and the jackets can be fed, with a defined projection, to the elevating platform via the transporters in a continuous movement.

3. A bookbinding machine according to claim 2, including jacket chain drives disposed on either side of a longitudinal central line and are offset in pairs in relation to one another in the conveying plane and which are connected to one another in an articulated manner via transporters designed as couplers, for the purpose of performing a rectilinear parallel movement in the rerouting system.

4. A bookbinding machine according to claim 1, including jacket chain drives disposed on either side of a longitudinal central line and are offset in pairs in relation to one another in the conveying plane and which are connected to one another in an articulated manner via transporters designed as couplers, for the purpose of performing a rectilinear parallel movement in the rerouting system.

5. A bookbinding machine comprising:

a transport system having clamps for holding a stack of sheets for transport along a first plane of movement;

a jacket laying-on device having stationary lateral jacket guides running parallel to said first plane and a jacket chain conveyor underneath the first plane, having endless loop drive chains cyclically running around rerouting sprocket gears at a jacket discharge end;

jacket transporters for engagement of the back edges of the jacket, said transporters further having articulated connections to said chains so as to remain substantially parallel to said first plane of movement throughout the cycle of the chains, and during a portion of the cycle, project beyond the sprocket gears at the jacket discharge end, for pushing of the jackets beyond the sprocket gears, in a second plane parallel to said first plane; and an elevating platform positioned in front of said jacket discharge end, for receiving the jacket from the projecting transporters, and raising the jacket into aligned contact with the back surface of the moving stack of sheets.

6. A bookbinding machine according to claim 5, wherein the jacket chain conveyer can be driven, with the transporters, by the transport system and the jackets can be fed to the elevating platform via the transporters in a continuous movement.

7. A bookbinding machine according to claim 6, including jacket chain drives disposed on either side of a longitudinal central line wherein the chain drives are offset in pairs in relation to one another in the conveying plane and are connected to one another in an articulated manner via transporters designed as couplers, for the purpose of performing a rectilinear parallel movement in the rerouting system.

8. A bookbinding machine according to claim 5 including jacket chain drives disposed on either side of a longitudinal central line wherein the chain drives are offset in pairs in relation to one another in the conveying plane and are connected to one another in an articulated manner via transporters designed as couplers, for the purpose of performing a rectilinear parallel movement in the rerouting system.

9. A bookbinding machine according to claim 5, wherein the transporters have frontal shoulders.

10. A bookbinding machine according to claim 9, wherein the frontal shoulders are located on the transporters for projection with the transporter beyond the sprocket gears at the jacket discharge end during said portion of the cycle.

* * * * *